US008939854B1

(12) United States Patent
Jones, Sr.

(10) Patent No.: US 8,939,854 B1
(45) Date of Patent: Jan. 27, 2015

(54) DEVICE FOR BASEBALL TRAINING

(75) Inventor: Daniel Lawrence Jones, Sr., Dawson Springs, KY (US)

(73) Assignee: Daniel L. Jones, Dawson Springs, KY (US)

( * ) Notice: Subject to any disclaimer, the term of this patent is extended or adjusted under 35 U.S.C. 154(b) by 206 days.

(21) Appl. No.: 13/423,784

(22) Filed: Mar. 19, 2012

(51) Int. Cl.
*A63B 69/00* (2006.01)

(52) U.S. Cl.
USPC ..... 473/454

(58) Field of Classification Search
USPC ..... 473/454–456; 273/398–402
See application file for complete search history.

(56) References Cited

U.S. PATENT DOCUMENTS

| | | | | | |
|---|---|---|---|---|---|
| 1,043,308 | A | * | 11/1912 | Everson | 473/432 |
| 1,142,184 | A | * | 6/1915 | Lawrence | 473/454 |
| 4,118,028 | A | * | 10/1978 | Larkin | 473/456 |
| 4,204,677 | A | * | 5/1980 | Haggarty | 473/454 |
| 4,210,326 | A | * | 7/1980 | Booth et al. | 473/454 |
| 4,254,952 | A | * | 3/1981 | Playter, Jr. | 473/456 |
| 4,390,181 | A | * | 6/1983 | Parish | 473/455 |
| 4,768,784 | A | * | 9/1988 | Wilson | 473/454 |
| 4,781,376 | A | | 11/1988 | Barnes, Sr. | |
| 4,830,369 | A | | 5/1989 | Poitras | |
| 4,913,427 | A | | 4/1990 | Wilson | |
| 4,955,607 | A | | 9/1990 | Maye | |
| 4,978,121 | A | * | 12/1990 | Larkey | 473/454 |
| 5,133,548 | A | | 7/1992 | Bedford et al. | |
| 5,271,616 | A | | 12/1993 | Grimaldi | |
| 5,433,434 | A | | 7/1995 | Helmetsie | |
| 5,511,775 | A | | 4/1996 | Parks | |
| 5,527,032 | A | * | 6/1996 | Coleman et al. | 473/439 |
| 5,573,240 | A | | 11/1996 | Humboldt | |
| 5,588,645 | A | | 12/1996 | Schwan et al. | |
| 6,093,120 | A | | 7/2000 | Luke, Jr. | |
| 6,189,889 | B1 | * | 2/2001 | Yip | 273/348 |
| 6,517,452 | B2 | | 2/2003 | Endres | |
| 6,695,725 | B1 | * | 2/2004 | Burns, Jr. | 473/454 |
| 6,878,078 | B2 | | 4/2005 | Swanson | |
| 7,021,630 | B1 | * | 4/2006 | Cho | 273/401 |
| 7,393,291 | B2 | * | 7/2008 | Huang et al. | 473/456 |
| D643,888 | S | * | 8/2011 | Essex | D21/699 |
| 8,540,593 | B1 | * | 9/2013 | Marnane | 473/454 |
| 8,591,356 | B2 | * | 11/2013 | Walker | 473/456 |
| 2004/0180736 | A1 | * | 9/2004 | Majumdar | 473/454 |
| 2008/0248901 | A1 | * | 10/2008 | Mosier et al. | 473/454 |
| 2008/0293521 | A1 | * | 11/2008 | Bishop | 473/456 |
| 2010/0075783 | A1 | * | 3/2010 | Edmondson | 473/421 |
| 2011/0003653 | A1 | * | 1/2011 | Stemle | 473/456 |
| 2011/0183786 | A1 | * | 7/2011 | Chen | 473/500 |
| 2012/0052989 | A1 | * | 3/2012 | Bishop | 473/456 |

* cited by examiner

*Primary Examiner* — Mark Graham
(74) *Attorney, Agent, or Firm* — Waddey Patterson; Mark A. Pitchford

(57) ABSTRACT

A device for Baseball pitcher training, employing a heavy, rigid, frame, heavy anterior target or impact drape, and heavy posterior target or impact drape.

16 Claims, 12 Drawing Sheets

DEVICE FOR BASEBALL TRAINING

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of athletic development and more specifically to a device for Baseball training.

Baseball is a popular sport having many avid participants who spend considerable time and effort practicing and developing their skills. To facilitate said practice, numerous mechanical devices have been contrived, especially for pitchers. Said devices generally include a means to receive thrown baseballs and to indicate whether or not a pitch would be successful, in example a strike. Said devices may also comprise means to collect thrown baseballs and/or means to return said received and collected baseballs to the pitcher.

U.S. Pat. No. 5,433,434 by Helmetsie recites a pitching, throwing, or kicking training device having a frame enshrouded by containment material to comprise a chamber with an open front so that balls pitched through the opening will be contained and collected. An adjustable two dimensional strike zone target having borders and an open center through which a ball may pass is suspended in the opening from the frame. A secondary target may be supported behind the strike zone target. A ball may pass into the chamber either through the strike zone target or above, below, or to either side of the strike zone target.

In contrast, the instant art does not comprise an enshrouded chamber but two hanging sheets, one behind the other, of material sufficiently substantial to absorb the momentum of a pitched ball. The front sheet has an opening corresponding to a strike zone. The balls passing through the strike zone opening will be stopped by the rear sheet. Balls not passing through the strike zone opening will be stopped by the front sheet. Balls hitting the sheets will drop down into ball collection means where they may be returned to the pitcher.

U.S. Pat. No. 4,955,607 by Maye teaches a double loop device having a frame supporting two essentially annular loops which serve as two dimensional targets. Behind the frame is an enshrouded chamber with an open front to contain thrown balls which pass through or around the target frame.

In contrast, the instant art comprises no enshrouded chamber and allows pitches to pass through a target but not around the target. In additional contrast, Maye comprises no ball return means.

U.S. Pat. No. 4,781,376 by Barnes, Sr. discloses a pitcher training device having a frame supporting an enshrouded chamber with an open front. Supported in the chamber is a panel with a desired two dimensional target area delineated thereon.

In contrast, the instant has no enshrouded chamber and a target panel allowing balls to pass through, but not around, a delineated area. Also, the instant art teaches embodiments having ball collection and conveyance means to a ball return device.

U.S. Pat. No. 6,878,078 B2 by Swanson recites a pitcher training device having a two dimensional target structure suspended by a frame which comprises a ball stopping and containment structure behind the target. The target is constructed so as to produce a sound similar to a ball hitting a catcher's mitt and a visible indentation when struck by a pitched ball.

In contrast, the instant art does not require production of a particular sound nor the production of a visible indentation when struck by a pitched ball. Also, the instant art allows a pitched ball to pass through, but not around a target.

U.S. Pat. No. 5,573,240 by Humboldt recites a baseball stopping backstop having a frame supporting a substantially planar net. Attached to the net may be two dimensional targets and/or fig.s to represent batters.

In contrast, the instant art requires no netting and comprises target which allows balls to pass through but not around. In addition, the instant art does not require sound dampening material.

U.S. Pat. No. 6,093,120 by Luke, Jr. discloses a baseball pitcher training device having a supported essentially rectangular frame which comprises an open end of a bag which contains balls thrown through the frame which comprises a two dimensional representation of the strike zone.

In contrast, the instant art requires no netting and comprises target which allows balls to pass through but not around. In addition, the instant art does not require sound dampening material.

U.S. Pat. No. 4,830,369 by Poitras recites a baseball pitching device having a plurality of side by side two dimensional target panel members interfaced with electrical contacts and circuits which activate display devices indicating which panel has been hit.

In contrast, the instant art does not have side by side panels but has one panel in front of another. Poitras comprises no panel through which a ball may pass. The instant art neither teaches nor requires electrical systems or display devices.

U.S. Pat. No. 5,133,548 by Bedford et al. discloses a pitcher training device having a ball receiving chamber having a netting enshrouded chamber with an open end and a rear wall comprising a cushion which may have a two dimensional target thereon.

In contrast the instant art comprises no netting and no enshrouded chamber. The instant art has no cushion. The instant art has a target panel through which balls may pass and a plurality of panels one behind the other, features not taught by Bedford, et al.

U.S. Pat. No. 5,511,775 by Parks discloses a rebound sports target having a two dimensional target area comprising an energy dissipating target section comprising a bag into which balls fall after hitting the target and a netted backstop to catch balls not hitting the target section.

In contrast, the instant art comprises no netting, nor bag for receiving balls. The instant art comprises a target section balls pass through.

U.S. Pat. No. 4,913,427 by Wilson teaches a pitcher training device having a two dimensional target suspended by a frame. Balls may pass either through the target or around the target where they are stopped by a wall.

In contrast, the instant art provides an embodiment wherein a ball may pass through, but not around, a target.

U.S. Pat. No. 5,271,616 by Grimaldi teaches a pitcher training device having an enclosure comprising netting. A two dimensional target section is suspended in the enclosure.

In contrast, the instant art comprises no netting and comprises a target balls may pass through but not around.

U.S. Pat. No. 5,588,645 by Schwan et al. discloses a pitcher training device having a framework supporting one tarp draped over two horizontal supports, one behind the other. The front tarp section has an opening which serves a two dimensional target representation of the strike zone and the front tarp section extends to a cross member to form a pocket which will collect balls. Balls passing through the opening are stopped by the rear tarp section. Balls hitting the front tarp section but not passing through the target opening are stopped. In both instances, ball momentum is dissipated by the tarp in combination of flexing of the frame, and the ball falls to collection structure. The tarp must communicate at its top and bottom with cross members.

The front tarp section must extend to comprise a retention channel to collect spent baseballs, and there must be a baffle between the front tarp section and the rear tarp section to collect spent baseballs.

Schwan et al. recites two frame sections, a front section extending upwards at less than ninety degrees and a rear section extending upward at essentially ninety degrees. It is premised on light-weight frames supporting light-weight drapes.

The front frame must be light and flimsy enough to flex when the tarp it supports is hit by a baseball, and because said front frame must flex, it cannot be braced by members connecting the front frame with the rear frame. Neither does the front tarp section hang vertically. The frame comprises multiple parts that can be assembled and disassembled for transport.

In the existing art, there are many devices which serve to collect and/or return hurled baseballs to a pitcher, thusly eliminating the need for a second person, the catcher, and allowing a pitcher to practice throwing by himself.

However the two dimensional targets are disadvantageous because the all-important "strike zone" is three dimensional.

As seen in FIG. 1, parts of the strike zone (110) boundaries are dictated by the "home plate" in front of the batter. Home plate (100) is a pentagon having a 17 inch base (115) with parallel sides (120) extending perpendicularly approximately 8.5 inches from the opposite ends of the base (115), and 2 taper sides (125) approximately 12 inches long extending from the ends of the parallel sides (120) opposite the base (115) and meeting at a point. The home plate is located and orientated horizontally, on the ground with its 17 inch base (115) facing the pitcher. Home plate (100) thus comprises a plane geometric fig. Home plate (100) thus comprises a plane geometric fig. and serves as a reference fig. to define the strike zone (110).

Accordingly, as seen in FIG. 1, the created strike zone (110) is a prism (105) with faces (112) extending perpendicularly upwards from the sides of home plate (100) with the lower limit (113) defined by the hollow beneath the knee of a batter (not shown) and the upper limit (114) defined by a point half way between the batter's belt line and his shoulders (not shown).

FIGS. 2, 3, and 4 show the strike zone (110) from above, and demonstrate that its cross section conforms in shape to home plate (100). FIG. 2 shows that thrown baseballs (130) do not always have a trajectory comprising a plane perpendicular to the base (115) of home plate (100). Indeed, the consummate baseball pitcher rarely throws such a pitch, but intentionally throws the baseball (130) in such a way as to impart spin which causes the ball to deviate from a single plane flight path, that is to "move." Such pitches are classified according to the degree and direction of offset affected from an intuitively expected, or single planar trajectory. They include curveballs, sliders, split fingered fast balls, knuckleballs, moving fastballs, cut fastballs, screwballs, sinkers, and the like.

FIG. 2 additionally shows the trajectory of three different thrown balls, trajectory A, trajectory B, and trajectory C, as indicated by curved arrows. Thus it may be understood that trajectory A represents a "strike" because it passes through a portion of the strike zone, trajectory B represents a strike because it passes through a portion of the strike zone (110), but trajectory C does not constitute a "strike" because it does not pass through any portion of the strike zone (110). In the art, such a pitch is termed, albeit confusingly, a "ball."

Now, one may readily appreciate that in order to be most useful, a pitcher training device must indicate to the pitcher whether his pitch is a "ball" or a "strike" so that he may learn to execute the pitch techniques to selectively throw "balls" or "strikes." However, the two dimensional targets found in the extant art are not accurate determinants for this purpose.

This is because although targets are traditionally two-dimensional, a strike zone is three-dimensional. In illustration, FIG. 3 shows a two dimensional target (150) positioned just in front of the base (115) of home plate (100) and facing the pitcher. The target (150) and target face, are of the same width as home plate (100). It may be readily appreciated that said target face (150) may comprise also a height component and that it might be positioned to also conform to the face (112) of the strike zone (110) closest to the pitcher.

A pitch traveling trajectory A would impact the target and thus be judged a "strike". However, a pitch with trajectory B would also pass through the strike zone (110) but it would not impact the target (150) and accordingly, it would be improperly indicated as a "ball". A pitch with trajectory C would not strike the target (150), and would not pass through the strike zone (110), and would thusly be correctly interpreted as a "ball".

Employing a different configuration, FIG. 4 also shows a two dimensional target (150). However, in this configuration, instead of facing the pitcher and positioned just in front of home plate, the target (150) is facing the pitcher and positioned just behind home plate (100). It has the same width as home plate (100) and it may be readily appreciated that said target (150) face may comprise a height component and that it might be positioned to conform to the face (112) of the strike zone (110) closest to the pitcher. In this fig., it is seen that a pitch with trajectory A would pass through a portion of the strike zone (110) but, yet, it would not strike the target (150) and thus be incorrectly judged a "ball". However, a pitch with trajectory B would also pass through the strike zone (110) to strike the target (150) and be properly indicated as a "strike." A pitch with trajectory C would not pass through the strike zone (110) but it would strike the target (150) and thusly be incorrectly indicated as a "strike."

Two dimensional targets (150) as in FIGS. 3 and 4 are, therefore, of limited value. They might well serve a pitcher throwing "non-moving" pitches in order to increase arm strength and/or endurance, or a younger pitcher who lacks sufficient strength or size to cause a baseball to "move," crossing the strike zone (110) without penetrating the front face of the strike zone (110).

However, as a pitcher matures, he must learn to throw "moving" pitches.

In example, pitches represented by trajectory B are called "back door" pitches. They are extremely difficult to hit; therefore, most accomplished pitchers throw them. However, the single two dimensional targets (150) of the extant art cannot indicate a successful "back door" pitch because they cannot indicate that a pitch has missed the front face of the strike zone (110) but intersected a posterior portion of the strike zone (110).

Therefore, in addition to a two dimensional target configuration, the instant art embodies a three-dimensional target which can indicate as a strike any pitch intersecting any portion of the strike zone (110). By adjusting the spacing between two target curtain faces, a pitcher can configure them to provide accurate, objective, indications as to whether he is successfully directing his pitches through his intended portions of a three-dimensional strike zone. The instant art is therefore a wanted advancement in the art of pitcher training devices.

In addition, the instant art comprises a stronger and more substantial construction than previous arts because all frames may be connected by braces. The frame of the instant art needs not flex to successfully absorb ball impacts. The instant art drapes, being substantial, need not be connected to frame base members to remain stable. All instant art drapes hang vertically. The structurally heavy, vertically upright front frame will support weightier drapes. Such heavy and substantial drapes as permitted by the instant art are resistant to ballistic displacement, and absorb impacts with little discernible motion. This is a time saving advantage for efficient training.

The instant art also incorporates embodiments that require no baffles or other spent baseball collection elements.

BRIEF SUMMARY OF THE INVENTION

One object of the invention is to allow a baseball pitcher to train without assistance.

Another object of the invention is to indicate to a pitcher the limits of an entire three-dimensional strike zone.

Still another object of the invention is employment of framework sufficiently substantial that it does not flex when elements supported thereby absorb the impact of thrown baseballs.

Still another object of the invention is to be substantial enough to be left in operative configuration on site for an extended period of time.

Another object of the invention is ability to withstand high velocity baseball impacts.

A further object of the invention is to collect thrown balls.

Yet another object of the invention is to return thrown balls to a pitcher.

Still yet another object of the invention is to be adaptable to training for various pitching strategies.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a device for baseball training comprising: frame, anterior drape, and posterior drape.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIGURE DESCRIPTIONS

Figure 1:
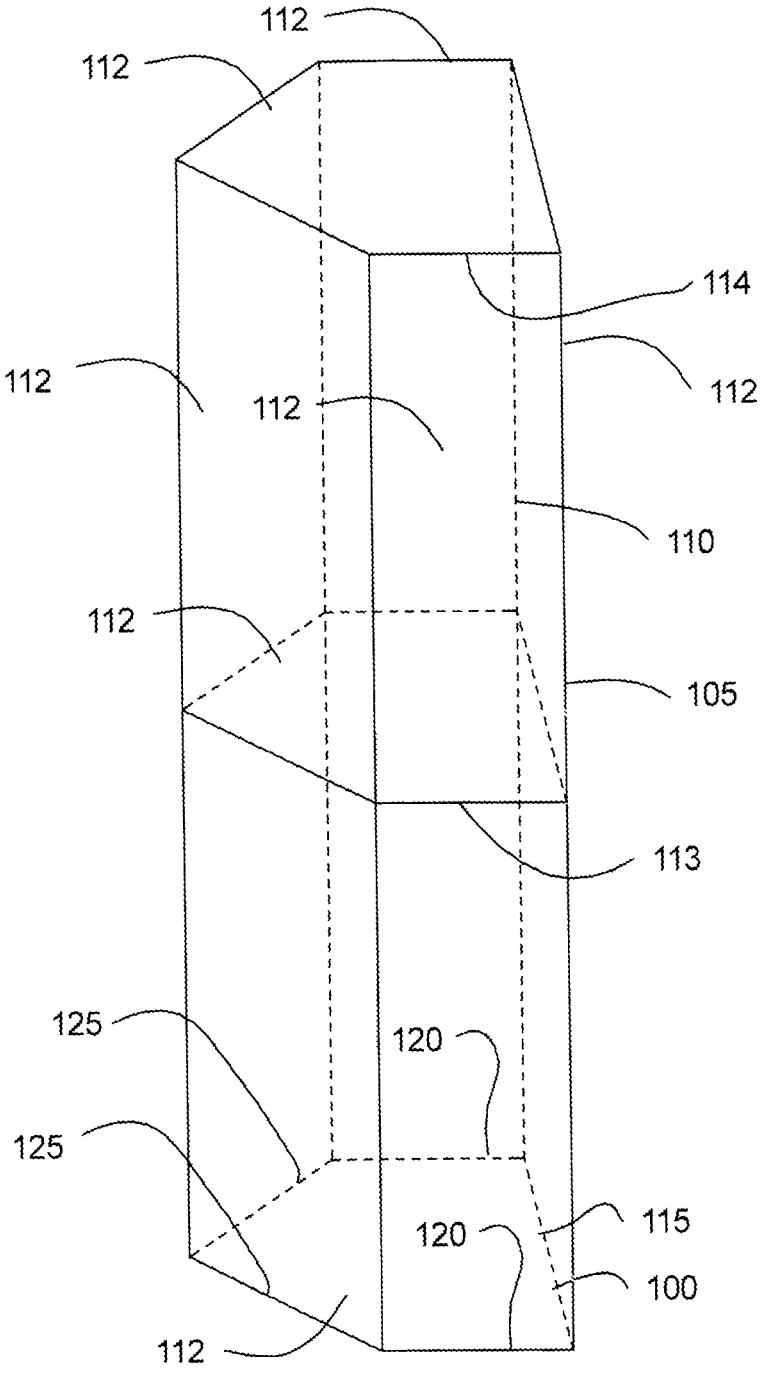

FIG. 1 is a perspective view of a representation of the strike zone.

Figure 2:
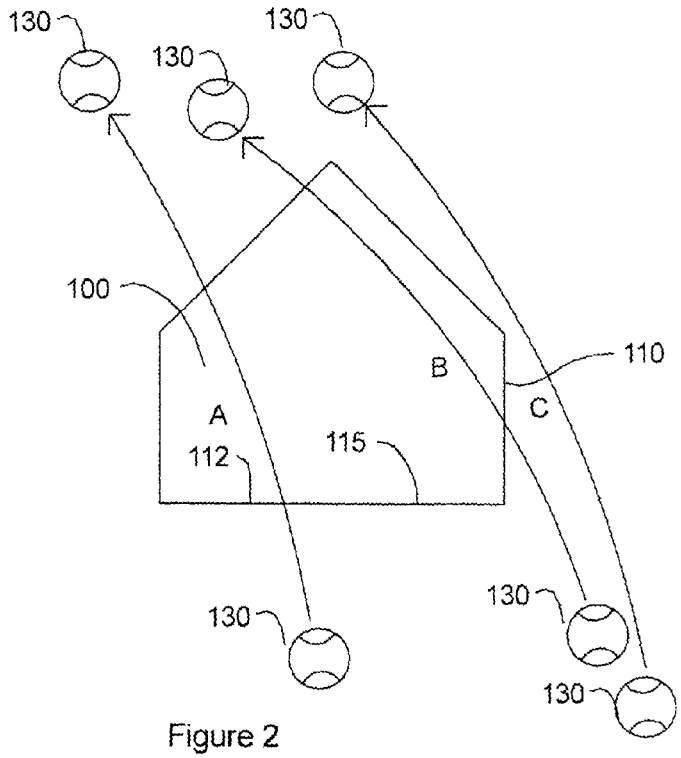

FIG. 2 is a top view of the strike zone.

Figure 3:
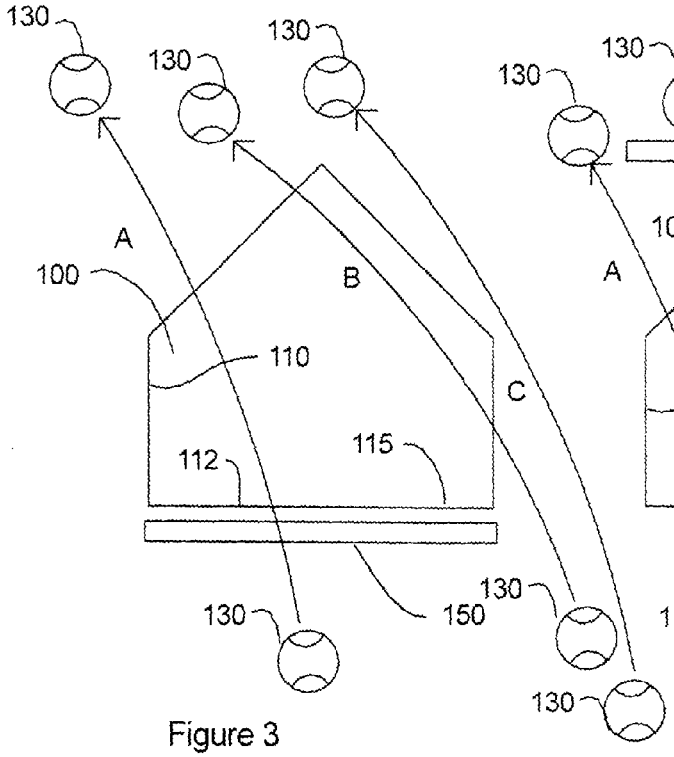

FIG. 3 is a top view of the strike zone.

Figure 4:
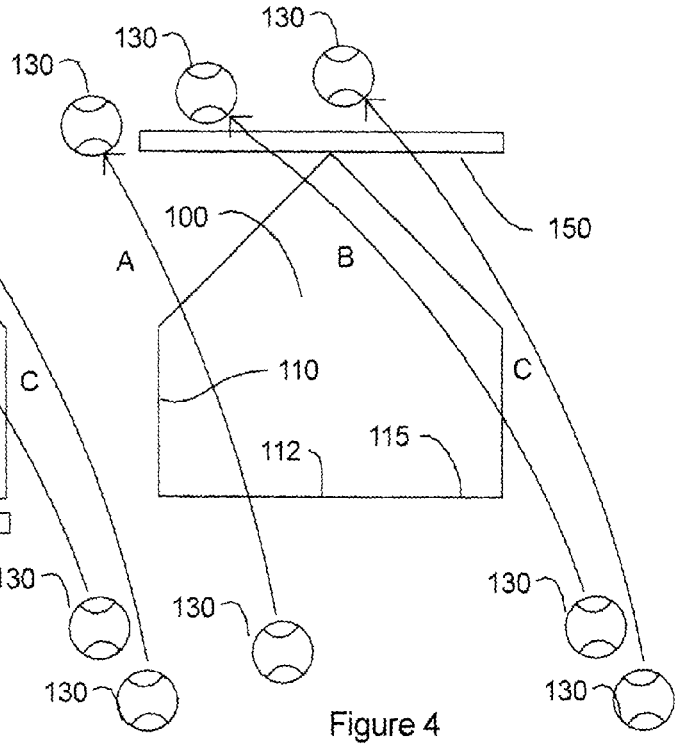

FIG. 4 is a top view of the strike zone.

Figure 5:
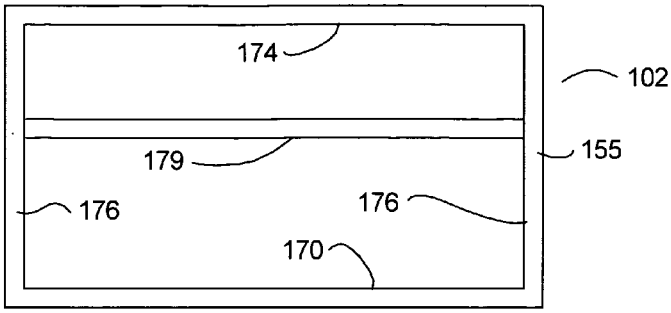

FIG. 5 is a top view of an embodiment of the invention.

Figure 6:
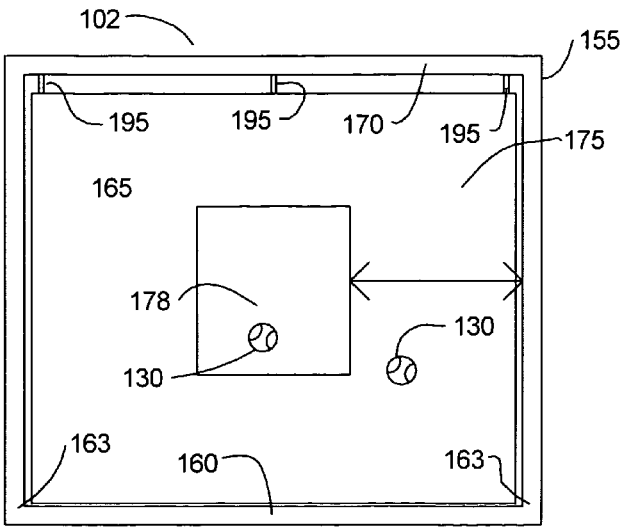

FIG. 6 is a front view of an embodiment of the invention.

Figure 7:
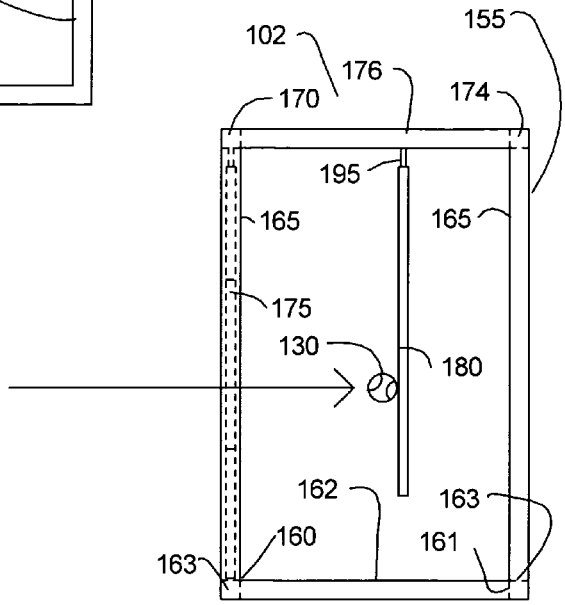

FIG. 7 is a right side view of an embodiment of the invention.

Figure 7A:
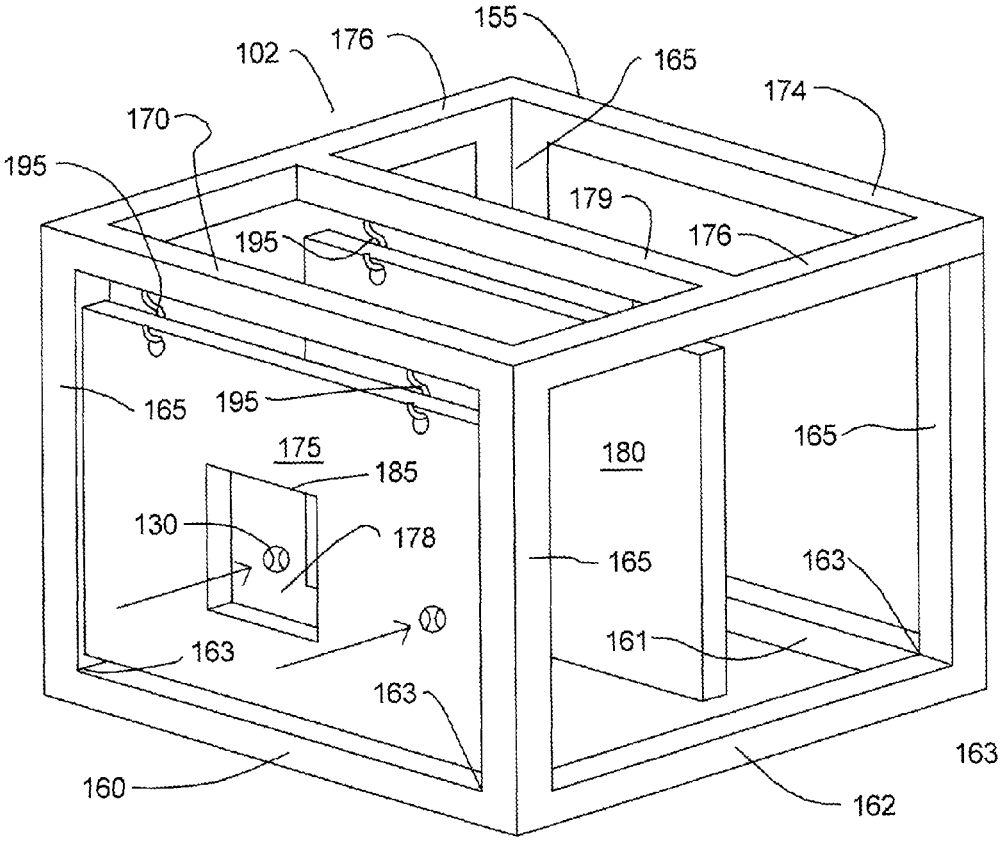

FIG. 7A is a perspective view of an embodiment of the invention.

Figure 7B:
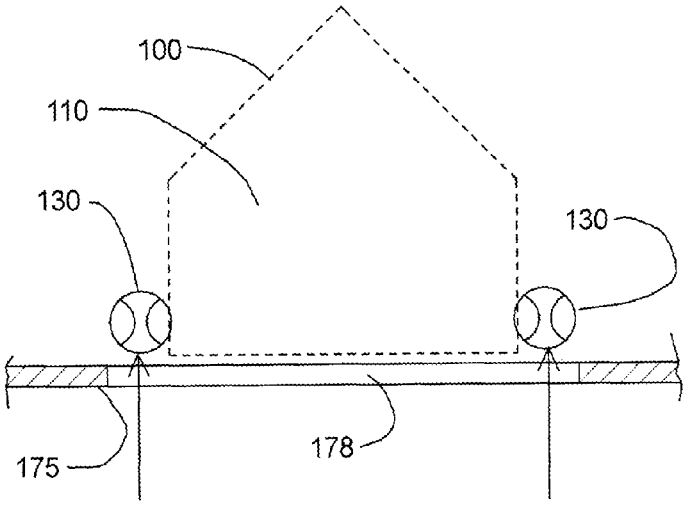

FIG. 7B is a top view of an embodiment of the invention.

Figure 8:
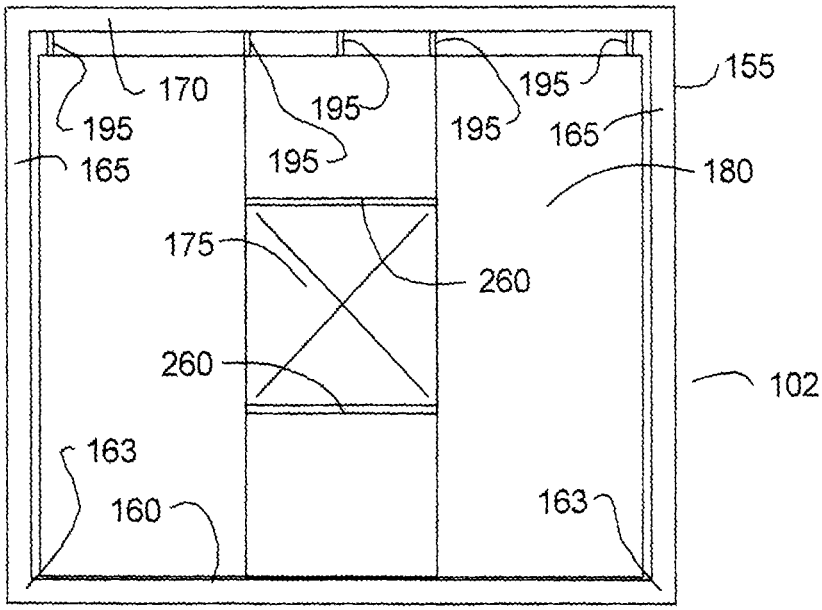

FIG. 8 is a front view of an embodiment of the invention.

Figure 9:
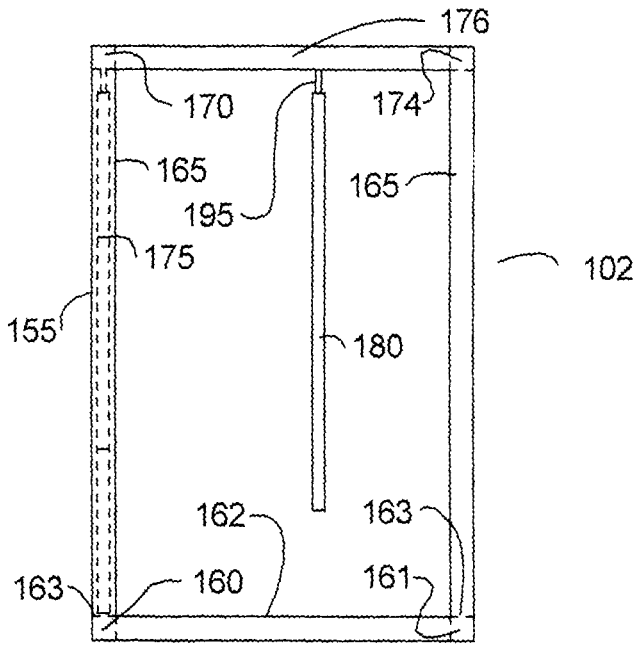

FIG. 9 is a right side view of an embodiment of the invention

Figure 10:
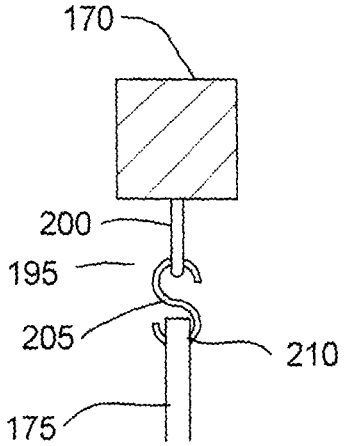

FIG. 10 is a side view of an element of an embodiment of the invention.

Figure 11:
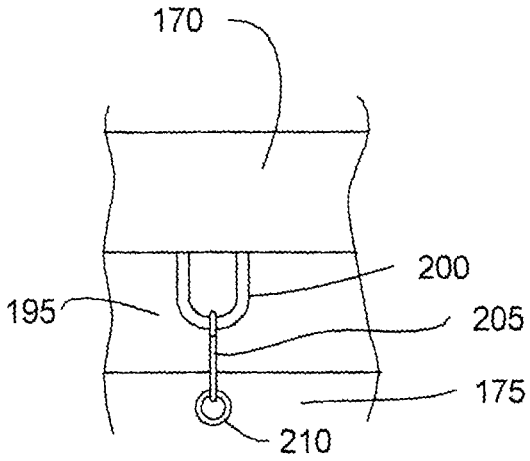

FIG. 11 is a front view of an element of an embodiment of the invention.

Figure 12:
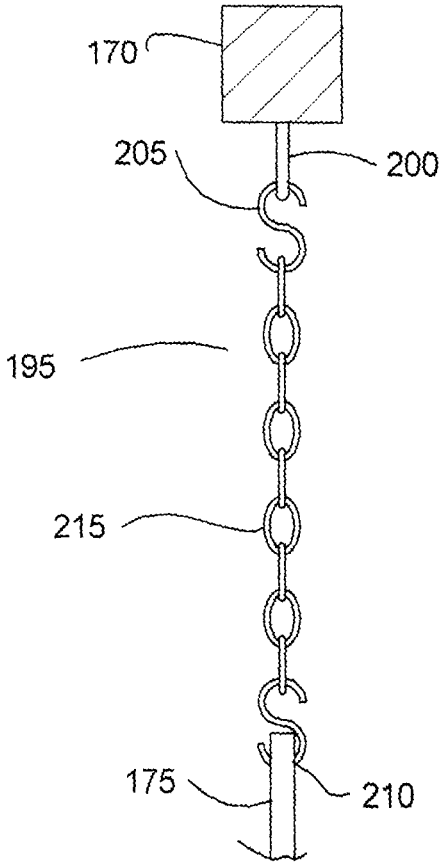

FIG. 12 is a side view of an element of an embodiment of the invention.

Figure 12A:
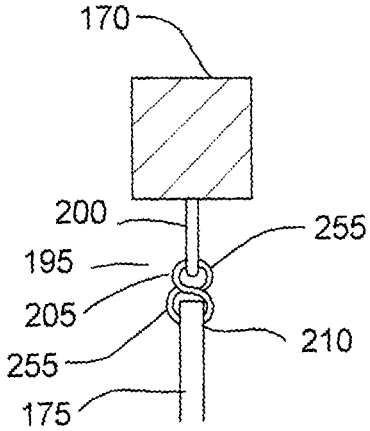

FIG. 12A is a side view of an element of an embodiment of the invention.

Figure 13:
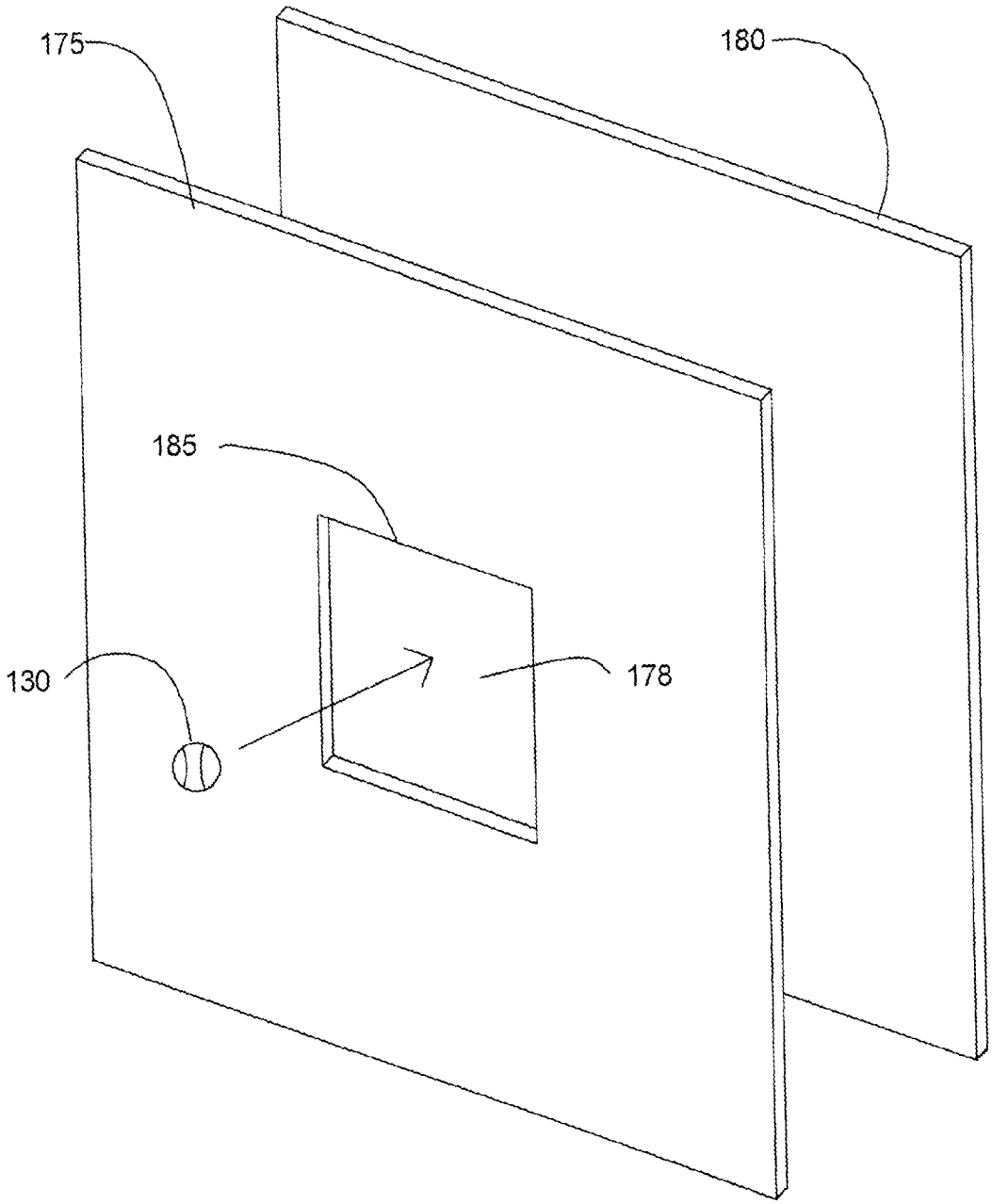

FIG. 13 is a perspective view of elements of an embodiment of the invention.

Figure 14:
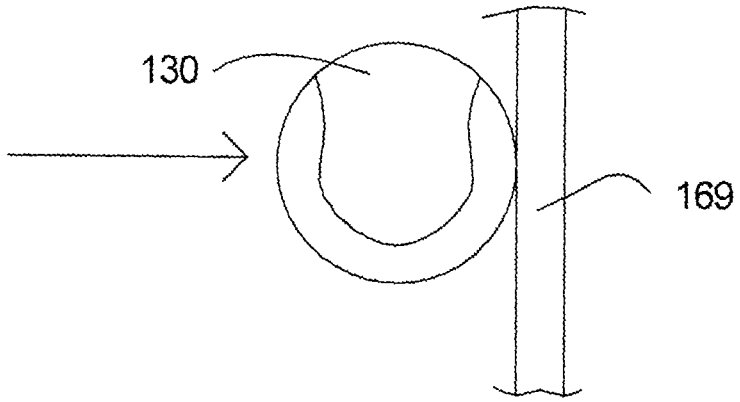

FIG. 14 is a side view of an element of the invention.

Figure 15:
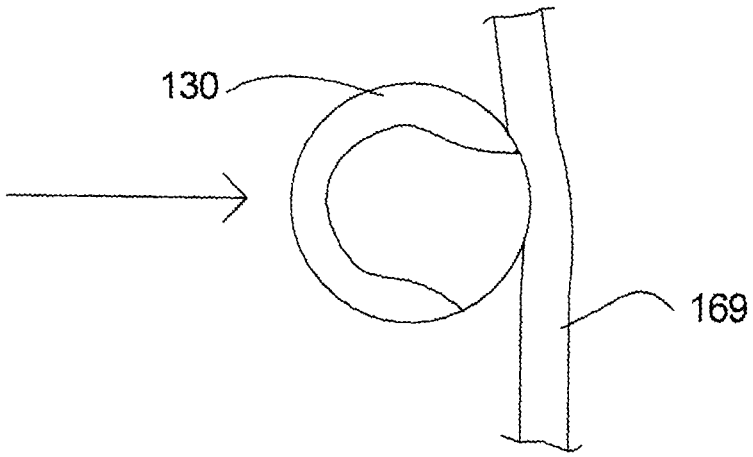

FIG. 15 is a side view of an element of the invention

Figure 16:
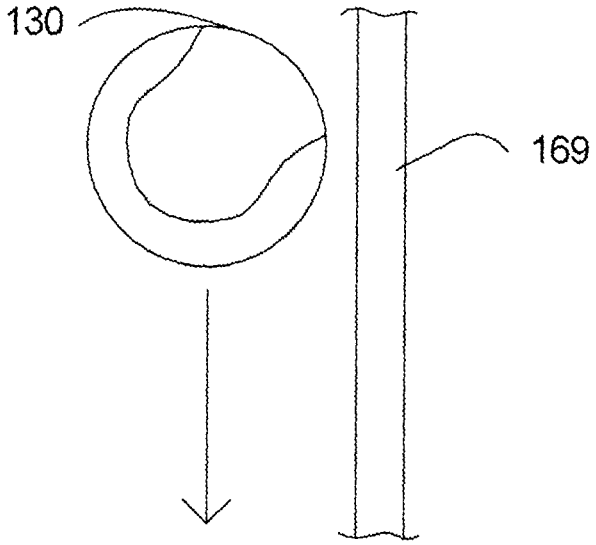

FIG. 16 is a side view of an element of the invention.

Figure 17:
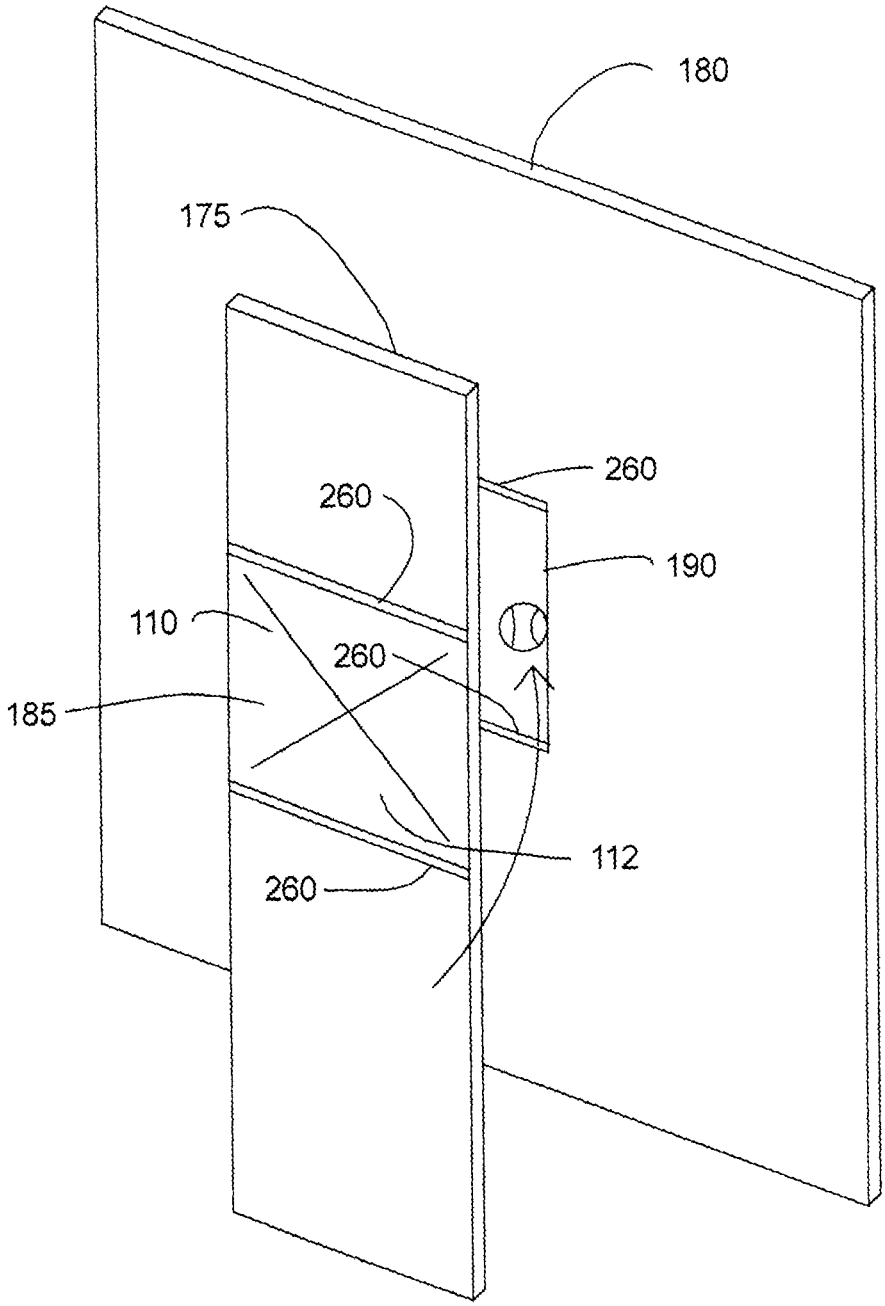

FIG. 17 is a perspective view of elements of an embodiment of the invention.

Figure 18:
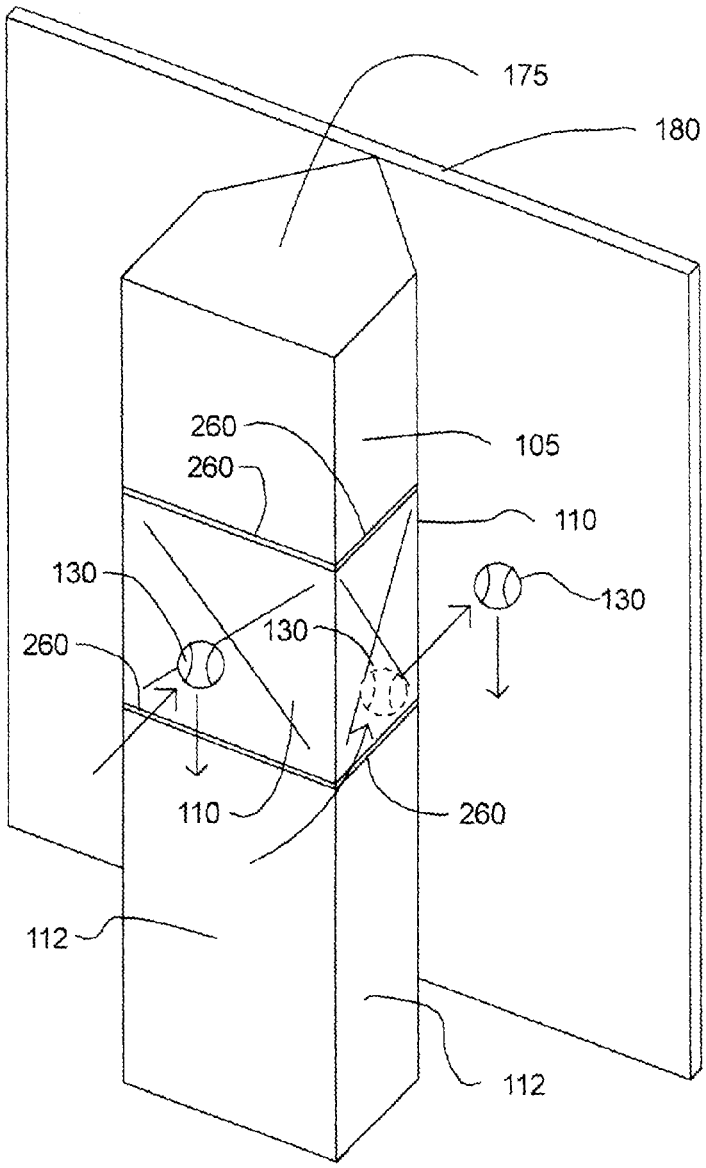

FIG. 18 is a perspective view of elements of an embodiment of the invention.

Figure 19:
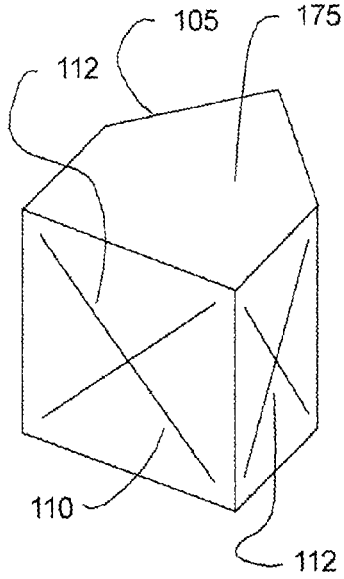

FIG. 19 is a perspective view of an element of an embodiment of the invention.

Figure 20:
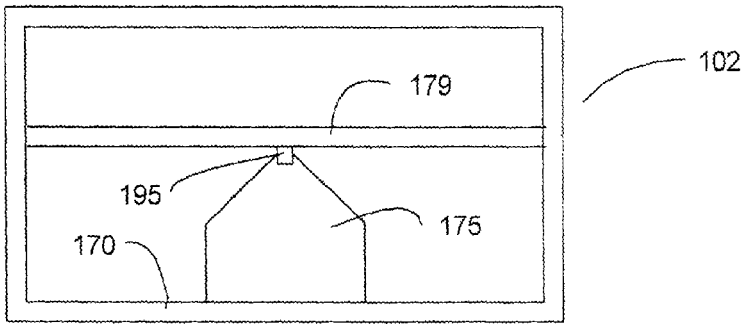

FIG. 20 is a top view of an embodiment of the invention.

Figure 21:
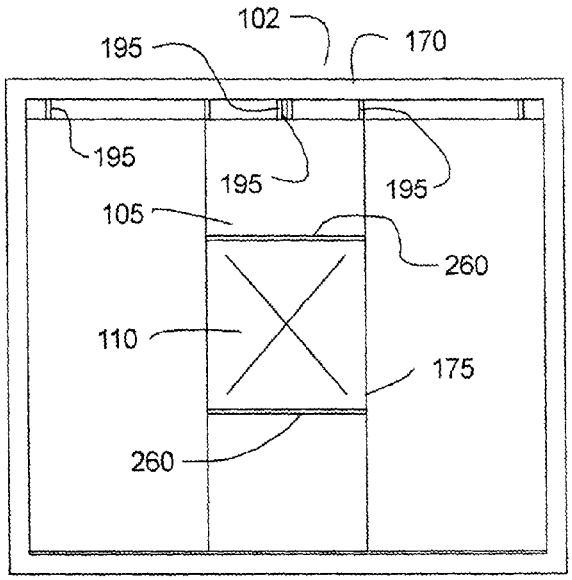

FIG. 21 is a front view of an embodiment of the invention.

Figure 22:
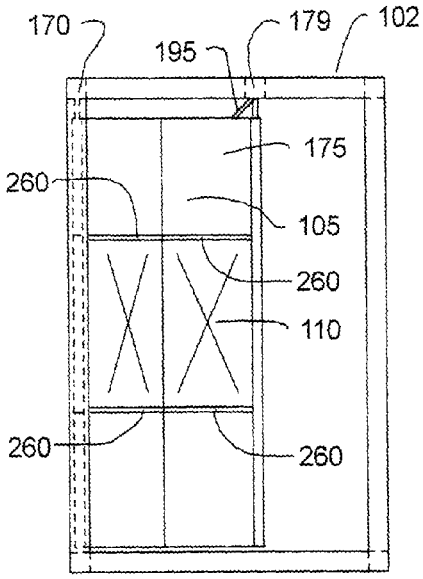

FIG. 22 is a right side view of an embodiment of the invention.

Figure 23:
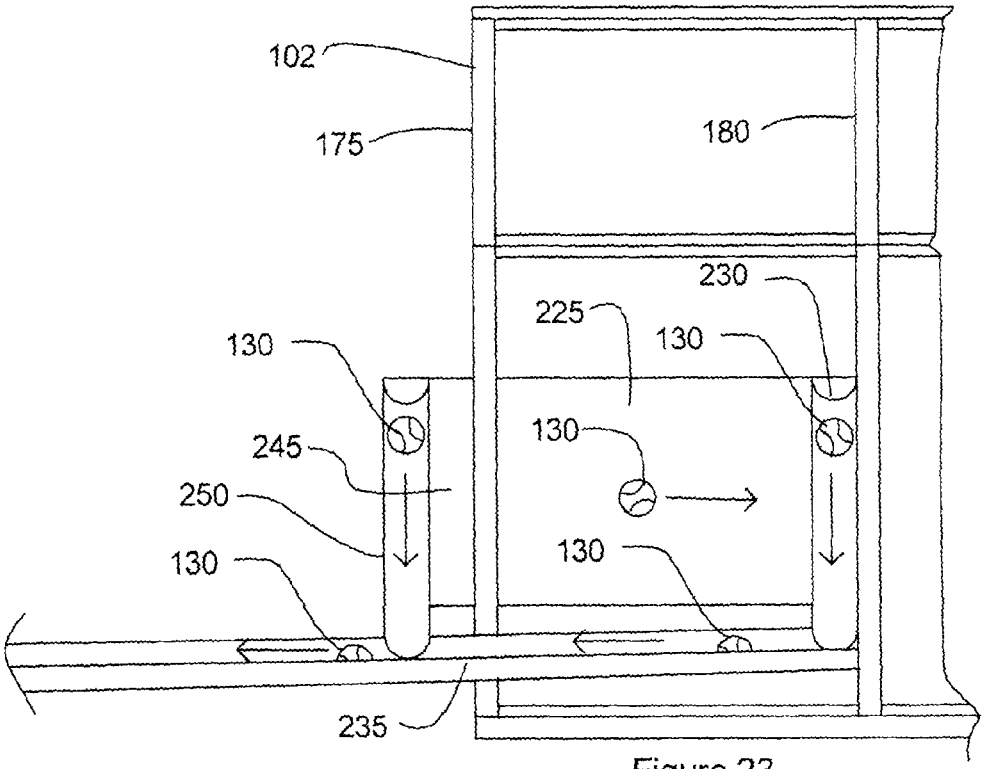

FIG. 23 is a right side view of an embodiment of the invention.

Figure 24:
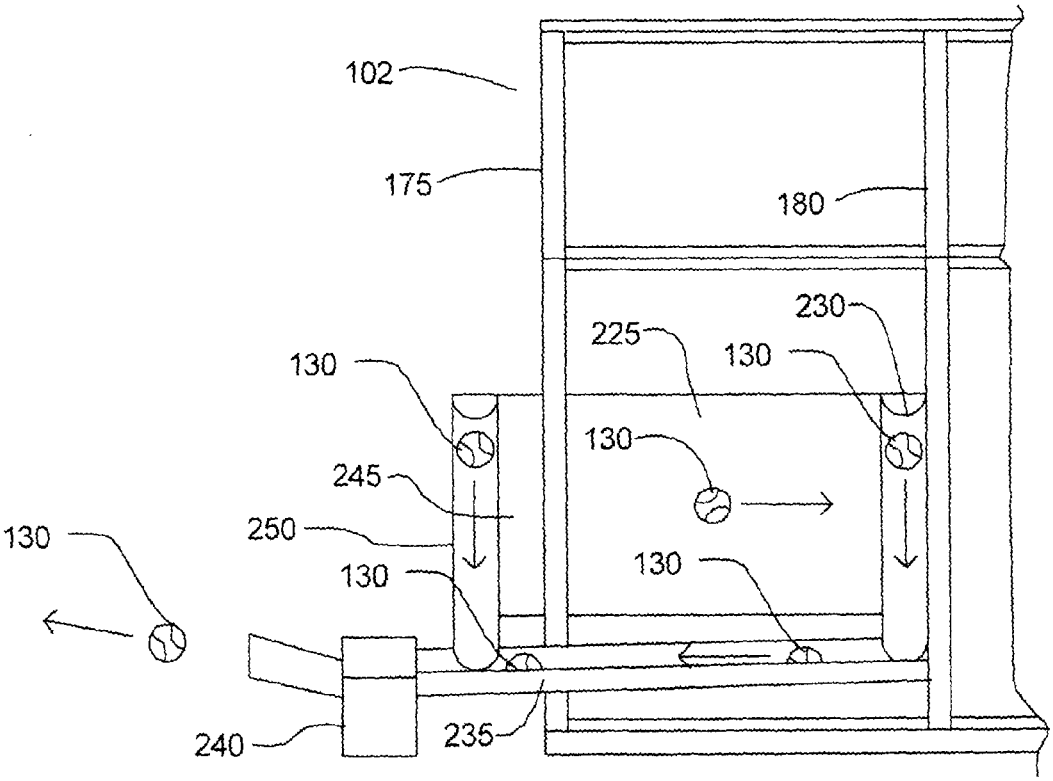

FIG. 24 is a right side view of an embodiment of the invention.

LIST OF NUMBERED COMPONENTS

100 Home plate
102 Baseball pitcher training device
105 Prism
110 Strike zone
112 Strike zone face
113 Strike zone lower limit
114 Strike zone upper limit
115 Home plate base
120 Home plate parallel sides
125 Home plate taper sides
130 Baseball
135 Trajectory A
140 Trajectory B
145 Trajectory C
150 Two-dimensional target
155 Frame
160 Front base member
161 Rear base member
162 Base brace member
163 Base corner
165 Upright member
169 Target drape
170 Anterior cross member
174 Posterior cross member

175 Anterior target drape
176 Top brace member
178 Aperture
179 Intermediate cross member
180 Posterior target drape
185 Anterior target
190 Posterior target
195 Drape suspension
200 Eye
205 Hook
210 Support hole
215 Chain
220 Ball collection means
225 Posterior floor
230 Posterior ball trough
235 Ball return trough
240 Ball projector
245 Anterior floor
250 Anterior ball trough
255 Closed loop
260 Strike zone delineation

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

FIG. 5, FIG. 6, FIG. 7 and FIG. 7A show a baseball pitcher training device (102) having a frame (155). Said frame has a front base member (160) and an essentially parallel rear base member (161) joined by base brace members (162) extending essentially normal from the front and rear base members (160, 161) joining the ends thereof and comprising base corners (163). Upright members (165) extend essentially normal therefrom. An anterior cross member (170) reaches from the ends of the upright members (165), extending from the front base member (160) opposite said front base member (160). A posterior cross member (174) extends between upright members (165). Top brace members (176) extend from the anterior cross member (170) to the posterior cross member (174). Referring to FIG. 5 and FIG. 7A, an intermediate cross member (179) extends between top brace members.

It is understood that the frame (155) may comprise any rigid structural members, in example tubular or angular metal, that are strong enough to withstand the forces imparted by impact of high velocity missiles, such as baseballs. The frame should also comprise sufficient weight to resist displacement while absorbing such impact forces. Also, though the frame (155) shown is rectangular and box-like, one skilled in the art will readily appreciate that other configurations may be exploited.

Suspended from the anterior cross member (170) is an anterior target drape (175). Suspended from the intermediate cross member (179) is a posterior target drape (180). As shown in FIG. 13, the anterior target drape (175) and the posterior target drape (180) are essentially parallel.

The anterior target drape (175) has an anterior target (185) which may comprise an aperture (178) through which a thrown baseball (130) may pass, as seen in FIG. 7A. Viewing FIGS. 7A and 7B, it will be understood that the aperture (178) may comprise dimensions corresponding to a typical strike zone face (112), in particular the face projecting upward from the home plate base (115), which would face a pitcher, as seen in FIG. 1.

Thus, any pitch passing through said aperture (178) would be determined a strike. It will also be readily appreciated that since a strike is any pitch wherein the baseball (130) touches the strike zone (110) and the baseball (130) is approximately three inches in diameter, the aperture (178) width may be proportionally larger than the width of home plate (100), that is, seventeen inches. In example, FIG. 7B shows the anterior target drape (175) having an aperture (178) wider than the strike zone (110), said width indicated by the base (115) of home plate (110). Said anterior target drape aperture (175) width relative the home plate (100) base (115) is contrived such that baseballs (130) passing through the aperture (178) must intersect the strike zone (110).

Suspended from the intermediate cross member (179) is a posterior target drape (180) disposed essentially parallel to the anterior target drape (175). Therefore the anterior target drape (175) and the posterior target drape (180) are suspended essentially parallel as shown in FIG. 13. It will thus be understood that any projectile not passing through the aperture (178) will strike the anterior target drape (175) and any projectile passing through the aperture (178) will strike the posterior target drape (180).

As shown in FIG. 10 and FIG. 11, the anterior cross member (170) may comprise an eye (200) depending therefrom and the anterior target drape (175) may comprise support holes (210). An S-type hook (205) may then be inserted through the eye (200) and the support hole (210) thus supporting the anterior target drape (175). FIG. 12A shows that the ends of the hook (205) may be crimped or bent back on themselves to comprise a closed loop (255).

One skilled in the art will readily appreciate that that the posterior target drape (180) may be suspended from the intermediate cross member (179) in like manner.

FIG. 12 shows that the suspension (195) might also comprise a chain (215), or other analogous device, in example, a rope, cord, strap, etc. so that the distance between the cross member (170) and the anterior target drape (175) and/or the distance between the intermediate cross member (179) and the posterior target drape (180) may be adjusted.

Alternatively, the suspension (195) might also comprise direct attachment of the drape (169) to a cross member with the resiliency and/or flexibility of the drape (169) allowing it to swing when struck by an object. Now, it will be understood that such drape suspensions (195) allow the anterior target drape (175) and the posterior target drape (180) to swing freely. However, the preferred weight of the drapes would preclude impact of pitches from actually generating perceptible swinging motion.

The anterior target drape (175) and the posterior target drape (180) comprise a flexible and/or resilient material capable of absorbing the energy of a projectile with a minimum of distortion and displacement, in example dense, vulcanized rubber fabric having a carcass thickness of approximately 12.7 to 15.9 millimeters. Such material has significant mass, and although not rigid, is necessarily of only limited flexibility. As a result, it consumes the force of pitch impact almost entirely within itself through momentum absorption and conversion to heat, while transmitting very little residual kinetic energy or motion to its surrounding environment.

FIGS. 14, 15, and 16 show that when a projectile, in example a baseball (130), hits the target drape (169), said drape (169) will slightly distend and be displaced. Then, the projectile energy dissipated, the projectile baseball (130), will fall substantially vertically as indicated by arrow in FIG.

16. Thus the physical characteristics of the target drapes (169) are contrived such that the distension and displacement of said target drapes (169) will be a minimal, and that the rebound of the projectile, baseball (130), after striking said drapes (169) will be minimal.

Now, it will be understood that the anterior target drape (175) and the posterior target drape (180) each comprise a separate plane when not functioning to absorb and/or dissipate the energy of a thrown projectile.

FIGS. 6 and 7 show that a baseball (130) passing through the aperture (178) will strike the posterior target drape (180) and that a baseball (130) not passing through the aperture (178) will strike the anterior target drape (175). As previously described, the force of said baseballs (130) will be dissipated and they will fall essentially vertically, as indicated by arrows. Said baseballs (130) will come to rest within a relatively small area where they can be conveniently gathered up and thrown again. The baseball training device (102) may also comprise means to return baseballs to the pitcher, as will be recited presently.

Returning to FIGS. 1, 2, 3, and 4, it will be understood that since some pitches, in example pitches having paths similar to trajectory C, though they are strikes will not pass through the aperture (178), a two dimensional representation of the strike zone (110), in the anterior drape (175) and would thus not be recognized as strikes.

FIGS. 8, 9, and 17 show the anterior target drape (175) configured to have no aperture. The target drape width is essentially equal to the width of the strike zone (110), which is the same as the width of home plate (100). As such, the anterior target drape (175) having no aperture (178), and a width of approximately, or slightly less than, seventeen inches, may be disposed substantially vertically and substantially parallel to the posterior drape (180). This is accomplished by suspending the drapes from, the intermediate cross member (179) and a posterior cross member (174), respectively, as seen in FIGS. 8 and 9.

FIG. 17 shows the anterior target drape (175), having no aperture, and of a width corresponding to that of a home plate (100), disposed to represent the face of the strike zone (112) facing the pitcher. FIG. 17 also shows that an example pitch, having trajectory as indicated by curved arrow, will not contact the anterior drape (175) but will pass around it and then intersect a portion of the strike zone (110). This is the classic "back-door" pitch, so named because it does enter the strike zone, but does not pass through the front face thereof. One skilled in the art will recognize that this is a pitch requiring great skill to accomplish, and there are limits to how much spin a pitcher may impart to a baseball and cause it to so "move" thereby.

Yet, to assist a pitcher in additionally developing his skill, the distance between the anterior target drape (175) and the posterior target drape (180) may be further adjusted, additionally refining the limiting dimensions and positions of portions of said posterior target drape (180) that will be struck by a pitch not contacting the anterior target drape (175) but intersecting the strike zone (110).

The respective parameters may be shown by delineations (260) on said posterior target drape (180), thus comprising a posterior target (190), that, in effect, provides a three dimensional representation of the strike zone (110). Thus, by throwing a pitch that does not intersect the anterior target drape (175) but does hit a delineated portion of the posterior target drape (180), the posterior target (190), a practicing pitcher may know if he has successfully executed a "back door" pitch.

FIG. 18 shows that the anterior target drape (175), rather than presenting a substantially two-dimensional surface to a pitcher, may comprise a long, vertical pentagonal prism (105) having shown by delineations (260) thereupon, the dimensions of a typical strike zone (110). Or, as in FIG. 19, said pentagonal prism (105) may be shorter and restricted to have only the dimensions of the typical strike zone (110).

Also, the posterior target drape (180) may be positioned essentially parallel to the pentagonal prism (105) such that said pentagonal prism (105) is between the pitcher and the posterior target drape (180).

FIGS. 20, 21, and 22 show that the anterior target drape (175) in the form of the pentagonal prism (105) may be suspended from the anterior cross member (170) and the posterior cross member (174) by drape suspensions (195) as previously described.

Now, it will be understood that a three dimensional representation of the typical strike zone (110) is presented to the pitcher. As a result, by striking said anterior target drape (175) on a face (112) not directly facing the pitcher, said pitcher may determine if he has successfully executed a "back door" pitch.

Additionally, it will be understood that pitches hitting the face (112) of the pentagonal prism (105) representing the extension from the home plate base (115) will distend and/or displace said prism (105) in the manner demonstrated by FIGS. 14-16 thusly dissipating the energy of a thrown baseball (130). Also, any thrown baseball (130) glancing off the prism (105) or not contacting the prism (105) will strike the posterior target drape (180) whereupon the energy of said baseball (130) will be dissipated as previously recited.

As previously described, the energy of thrown baseballs (130) is quickly dissipated into the heavy target drapes, either the anterior target drape (175) or the posterior target drape (180), causing the baseballs (130) to stop and fall essentially straight down from the contact point. Said baseballs (130) may fall into a collection means or device (222) from whence they may be automatically fed to a return device, or may be manually or automatically gathered and returned to the pitcher.

In example, FIGS. 23 and 24 show a posterior floor (225) having a posterior ball trough (230) disposed between the anterior target drape (175) and the posterior target drape (180) and having dimensions so that there is minimum clearance between said posterior floor (225) having said posterior ball trough (230) and said anterior target drape (175) and said posterior target drape (180). Said clearance is small enough that the baseball (130), after dropping from the posterior target drape (180) as previously taught cannot pass between said posterior floor (225) having said posterior ball trough (230) but must land on said posterior floor (225) or said posterior ball trough (230). The posterior floor (225) and the posterior ball trough (230) are inclined such that balls landing on the posterior floor (225) or in the posterior ball trough (230) are directed by gravity to a ball return trough (235), which communicates with the posterior ball trough (230), whereupon the baseball (130) will roll by gravity to the pitcher as in FIG. 23.

FIG. 23 and FIG. 24 also show an anterior floor (245) having an anterior ball trough (250) disposed between the anterior target drape (175) and the pitcher, and having disposition so that there is minimum clearance between said anterior floor (225) having said anterior ball trough (250) and said anterior target drape (175). Said clearance is small enough so that the baseball (130), after dropping from the anterior target drape (175) as previously taught cannot pass between said anterior floor (245) having said anterior ball trough (250) but must land on said anterior floor (245) or said anterior ball trough (250). The anterior floor (245) and the anterior ball trough (250) are inclined such that balls landing on the anterior floor (245) or in the anterior ball trough (250) are directed by gravity to a ball return trough (235), which communicates with the anterior ball trough (250), whereupon the baseball (130) will roll by gravity to the pitcher as in FIG. 23.

FIG. 24 shows that the ball return trough (235) may communicate with a ball projector (240) which will project the baseball (130) to the pitcher. Alternatively, the baseballs (130) may be allowed to tumble to the ground and come to rest proximal the training device (102) where they may be easily gathered.

One skilled in the art will readily appreciate that the instant art, while it is transportable, comprises sufficient substance that it may be left on location in operative condition for extended periods of time. In example, the instant art may be placed proximal a practice field or in a special area of a park before baseball season and removed for storage after baseball season.

The structure is heavy enough to discourage theft and its components are not easily separable one from another.

In addition, the instant art is configurable in either a two dimensional strike zone presentation mode or a three dimensional strike zone presentation mode and re-configurable from one said mode to another. The instant art thus accommodates training and practice for a variety of baseball pitches and pitching strategies.

The instant art (102) may also be utilized by other players besides pitchers who must throw accurately, in example, outfielders who must throw to bases, cut-off men, relay men, or to home plate, infielders who must throw to first base or other bases, and catchers who must throw to bases from behind the plate.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A baseball training device comprising:

a frame comprising an anterior cross member and an intermediate cross member;

an anterior drape suspended vertically from the anterior cross member, wherein the anterior drape has an aperture through which a ball may pass;

a posterior drape suspended vertically from the intermediate cross member; and a trough system suspended from the frame, said trough system comprising:

a return ball trough;

an anterior ball trough positioned anterior of the anterior drape and inclined toward the return ball trough such that a ball within the anterior ball trough rolls toward the return ball trough due to a gravitational force; and a posterior ball trough between the anterior drape and posterior drape, said posterior ball trough connected to the return ball trough and inclined towards the return trough such that a ball within the posterior ball trough rolls toward the return ball trough due to a gravitational force;

wherein the return ball trough extends from the posterior ball trough to the anterior ball trough and is inclined from the posterior ball trough to the anterior ball trough such that a ball within the return ball trough between the posterior ball trough and the anterior ball trough will roll toward the anterior ball trough due to a gravitational force.

2. The baseball training device of claim 1, wherein the anterior drape is positioned substantially parallel with the posterior drape.

3. The baseball training device of claim 1, wherein the trough system further comprises a ball projector connected to the return ball trough and configured to receive a ball from the return ball trough and project the received ball away from the anterior drape and posterior drape.

4. The baseball training device of claim 1, wherein the aperture has a width substantially equal to a width of a baseball plate plus a diameter of a baseball.

5. The baseball training device of claim 1, wherein the trough system further comprises:

an anterior floor connected to the anterior trough and positioned between the anterior trough and the anterior drape, wherein the anterior floor is inclined toward the anterior trough such that a ball on the anterior floor rolls toward the anterior trough due to a gravitational force; and a posterior floor connected to the posterior trough and positioned between the posterior trough and the anterior drape, wherein the posterior floor is inclined toward the posterior trough such that a ball on the anterior floor rolls toward the posterior trough due to a gravitational force.

6. The baseball training device of claim 1, wherein the frame includes an anterior cross member and a posterior cross member, and wherein the anterior drape is exclusively attached to the anterior cross member such that the anterior drape hangs from the anterior cross member and the posterior drape is exclusively attached to the intermediate cross member such that the posterior drape hangs from the intermediate cross member.

7. The baseball training device of claim 1, wherein each drape is formed from a material comprising rubber, latex, butadiene, styrene, or synthetic rubber fabric.

8. A baseball training device comprising:

a frame comprising an anterior cross member and an intermediate cross member;

an anterior drape suspended vertically from the anterior cross member and configured to block an area corresponding in width and height to a face of a baseball strike zone over a baseball home plate; and a posterior drape, suspended vertically from the intermediate cross member, said posterior drape having a posterior target thereon, said posterior target having a height and width determined as a function of a distance between home plate parallel sides of the baseball home plate and the posterior drape, said height and width of the posterior target determined such that a ball thrown from in front of the anterior drape at a standard distance from the anterior drape, passing by the anterior drape without contacting the anterior drape, and striking the posterior drape within the posterior target necessarily passed over at least one of the home plate parallel sides of the baseball home plate.

9. The baseball training device of claim 8, wherein the anterior drape is positioned substantially parallel with the posterior drape.

10. The baseball training device of claim 8, further comprising a trough system comprising:

a return ball trough; and a posterior ball trough between the anterior drape and posterior drape, said posterior ball trough connected to the return ball trough and inclined towards the return trough such that a ball within the posterior ball trough rolls toward the return ball trough due to a gravitational force;

wherein the return ball trough extends away from the posterior ball trough past the anterior drape and is inclined from the posterior ball trough to the anterior drape such that a ball within the return ball trough between the posterior ball trough and the anterior drape trough will roll generally toward the anterior drape trough due to a gravitational force.

11. The baseball training device of claim 10, wherein the trough system further comprises an anterior ball trough positioned anterior of the anterior drape and inclined toward the return ball trough such that a ball within the anterior ball trough rolls toward the return ball trough due to a gravitational force.

12. The baseball training device of claim 10, wherein the trough system further comprises a ball projector connected to the return ball trough and configured to receive a ball from the return ball trough and project the received ball away from the anterior drape.

13. The baseball training device of claim 11, wherein the trough system further comprises:

an anterior floor connected to the anterior trough and positioned between the anterior trough and the anterior drape, wherein the anterior floor is inclined toward the anterior trough such that a ball on the anterior floor rolls toward the anterior trough due to a gravitational force; and a posterior floor connected to the posterior trough and positioned between the posterior trough and the anterior drape, wherein the posterior floor is inclined toward the posterior trough such that a ball on the anterior floor rolls toward the posterior trough due to a gravitational force.

14. The baseball training device of claim 12, wherein the anterior floor extends from the anterior trough to the anterior drape, and the posterior floor extends from the posterior trough to the anterior drape.

15. The baseball training device of claim 8, wherein each drape is formed from a material comprising rubber, latex, butadiene, styrene, or synthetic rubber fabric.

16. The baseball training device of claim 8, wherein the frame further comprises:

a front base member joined to the anterior cross member by a plurality of upright members; and a rear base member joined to the front base member by a plurality of base brace members.

* * * * *